US008227995B2

(12) United States Patent
Damink et al.

(10) Patent No.: US 8,227,995 B2
(45) Date of Patent: Jul. 24, 2012

(54) SENSING CODED LIGHT USING RETRO REFLECTORS

(75) Inventors: Paulus Henricus Antonius Damink, Eindhoven (NL); Sel Brian Colak, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 194 days.

(21) Appl. No.: 12/681,633

(22) PCT Filed: Oct. 6, 2008

(86) PCT No.: PCT/IB2008/054084

§ 371 (c)(1),
(2), (4) Date: Apr. 5, 2010

(87) PCT Pub. No.: WO2009/047693

PCT Pub. Date: Apr. 16, 2009

(65) Prior Publication Data

US 2010/0219761 A1 Sep. 2, 2010

(30) Foreign Application Priority Data

Oct. 12, 2007 (EP) ..... 07118380

(51) Int. Cl.
*H05B 37/02* (2006.01)

(52) U.S. Cl. ..... 315/152; 315/212; 315/363; 398/140; 398/182; 398/183; 398/208

(58) Field of Classification Search ..... 315/152, 315/312, 363; 398/140, 182, 183, 208
See application file for complete search history.

(56) References Cited

U.S. PATENT DOCUMENTS

| | | | | |
|---|---|---|---|---|
| 4,814,769 | A * | 3/1989 | Robin et al. | 342/45 |
| 5,485,301 | A * | 1/1996 | Miller | 398/129 |
| 5,502,297 | A * | 3/1996 | Sherman | 235/462.45 |
| 6,493,123 | B1 * | 12/2002 | Mansell et al. | 398/169 |
| 6,542,270 | B2 * | 4/2003 | Perkins et al. | 398/140 |
| 7,360,703 | B2 * | 4/2008 | McIntyre et al. | 235/454 |
| 2006/0016960 | A1 | 1/2006 | Morgan et al. | |
| 2006/0087841 | A1 | 4/2006 | Chern | |

FOREIGN PATENT DOCUMENTS

| | | | |
|---|---|---|---|
| JP | 10302535 | A | 11/1998 |
| JP | 2004296841 | A | 10/2004 |
| JP | 2007080533 | A | 3/2007 |
| WO | 9612248 | A1 | 4/1996 |
| WO | 02099333 | A1 | 12/2002 |
| WO | 2006111927 | A1 | 10/2006 |
| WO | 2006111930 | A2 | 10/2006 |
| WO | 2007004097 | A1 | 1/2007 |

* cited by examiner

*Primary Examiner* — Douglas W Owens
*Assistant Examiner* — Thai Pham
(74) *Attorney, Agent, or Firm* — Mark L. Beloborodov

(57) ABSTRACT

This invention relates to a luminaire comprising a light source emitting output light, and a detector unit, which is arranged to detect received light emanating from a remote reflection of said output light, wherein the detector unit comprises a first identifier, which is arranged to identify a remotely introduced reflector identifying light coding of the received light. The invention also relates to a method for determining a property of light at a remote position.

10 Claims, 3 Drawing Sheets

SENSING CODED LIGHT USING RETRO REFLECTORS

FIELD OF THE INVENTION

The present invention relates to lighting systems employing light coding techniques for light environment control purposes, such as controlling light effects in specific positions.

BACKGROUND OF THE INVENTION

One example of such a lighting system is disclosed in the international application WO 2006/111927, which was published 26 Oct. 2006. The lighting system comprises several lighting arrangements mounted in a room. The lighting arrangements emit light modulated with an individual identification code under the control of a main control device. Furthermore, the system includes a user control device. By (i) measuring the light at different positions using the user control device, (ii) deriving the contributions from each one of the lighting arrangements based on their individual identification codes, and (iii) transfer light data representative of the measured light to the main control device, the system creates a feed-back loop from the emitted light to the main control device. The main control device then adjusts the drive data to the lighting arrangements based on the feed-back light data and additional user input. With the aid of a computer program the main control device determines the influence or effect that a specific change of the main control drive data has on the derived light data at the current location, and the main control device learns, ad-hoc, how to obtain a desired light effect at a certain location.

It is desirable to provide a lighting system which is simpler in regard to the user control device.

SUMMARY OF THE INVENTION

It is an object of the present invention to provide a solution which provides a lighting system with the capability of determining a light effect at a desired position without the need of a local processing node at the position.

This object is achieved by a luminaire, a lighting system and a method according to the present invention as defined in the claims.

Thus, in accordance with a first aspect of the present invention, there is provided a luminaire comprising a light source emitting output light, and a detector unit, which is arranged to detect received light emanating from a remote reflection of said output light. The detector unit comprises a first identifier, which is arranged to identify a remotely introduced reflector identifying light coding of the received light.

In accordance with a second aspect of the present invention, there is provided a lighting system comprising a plurality of luminaires of the structure just mentioned, and a retro-reflector. The retro-reflector is arranged to provide said remote reflection, and comprises a second light coder, which is arranged to code the reflected light by means of a reflector identifying light coding, and a central control unit, which is connected with the luminaires. The central control unit is arranged to process an output signal of each one of the detectors of the luminaires to determine at least one light property thereof.

In accordance with a third aspect of the present invention, there is provided a method for determining a property of light at a remote position comprising:

generating light at a luminaire;

emitting the generated light from the luminaire as output light;

receiving, at the luminaire, light emanating from a remote retro-reflection of said output light;

identifying a remotely introduced reflector identifying light coding of the received light; and determining a light property of said received light.

Thus, by means of using a reflection of the light emitted from one or more luminaires, by means of adding a coding that is associated with the reflection position, and by means of providing a capability of detecting the reflected light at the one or more luminaires, it is possible to eliminate the processing capability at the position. Since the light that is received at the luminaire is reflected straight back to where it came from, which is a particular property of a retro-reflector, and since the light is coded with a code that is associated with the reflecting object it is possible to determine what part of all light that is received by the detector comes from the position in question. Any other ambient light originated from other light sources or originated from the luminaire but reflected at other positions than the one in question is sorted out. The retro-reflector reflects a light ray back from where it came regardless of angle of incidence.

It should be noted that the use of a light modulating retro-reflector, that is part of the lighting system as defined above, is known as such but from other technical fields, which are not relevant here. For example, one application is mentioned in U.S. Pat. No. 6,493,123, where a retro-reflector is used for identifying a vehicle. A laser source generates a beam and the retro-reflector, which is mounted on a vehicle, reflects the beam while modulating the polarization of the reflected beam with identification information. The polarization modulation is used as identification in order to enable determination of the position of the vehicle. However, as already made clear, this prior art relates to quite a different technical field, and it would have necessitated inventive skill to look for the patent in question in the first place and to realize that such a reflector would be useful to obtain the object mentioned above as well.

In accordance with an embodiment of the luminaire as defined in the claims, the luminaire further has a light coder, which is arranged to code the output light of the luminaire by means of an individual coding, and the detector unit includes a second identifier, which is arranged to identify the individual coding. This embodiment increases the significance of the detected light to ensure that it originated from the detecting luminaire itself.

In accordance with an embodiment of the luminaire as defined in the claims, the light coder comprises an amplitude modulator, and the first identifier comprises one of a frequency demodulator, a CDMA demodulator, and a on/off keying demodulator. These alternatives represent favorable combinations of techniques for the double coding of the light. That is, the coding of the light emitted by the luminaire and the reflection identifying coding of the reflected portion thereof, which is dealt with at the first identifier.

In accordance with an embodiment of the luminaire as defined in the claims, the light coder comprises one of a pulse width modulator, and a combination of a pulse width modulator and a CDMA-modulator, and wherein said first identifier comprises a high frequency demodulator. These are further advantageous combinations of coding.

In accordance with an embodiment of the luminaire, as defined in the claims, the light coder comprises a pulse width modulator and a CDMA-modulator, and wherein said first identifier comprises a low frequency demodulator. This is yet another advantageous alternative.

In accordance with an embodiment of the luminaire as defined in the claims, the detector unit further comprises a light property determining means, arranged to determine at least one light property of the received light. This is an advantageous place for a determining means, which could alternatively be arranged externally of the luminaire as will be described below. By equipping the luminaire with this capability the luminaire becomes somewhat an autonomous entity. The determining means is implementable as anything from a rather simple microcontroller to a full central processor depending on demand.

In accordance with an embodiment of the luminaire as defined in the claims, the luminaire further comprises a transmitter, which is connected with the detector unit for transmitting an output signal thereof. By means of the transmitter detected signals or values are forwardable to external devices, such as for instance a central controller controlling a plurality of luminaries, an man-machine interface, or some kind of monitoring or light property determining device.

In accordance with an embodiment of the lighting system as defined in the claims, the central control unit is further arranged to estimate, on the basis of said at least one light property, a current light effect at a position of the retro-reflector and to control the luminaries in order to obtain a desired light effect at said position. This embodiment represents an advantageous application of the control possibilities obtained by the present lighting system.

In accordance with an advantageous embodiment of the method as defined in the claims, the generated light is coded with an individual coding, and that individual coding is recognized, in addition to the reflector identifying coding, in the received light.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
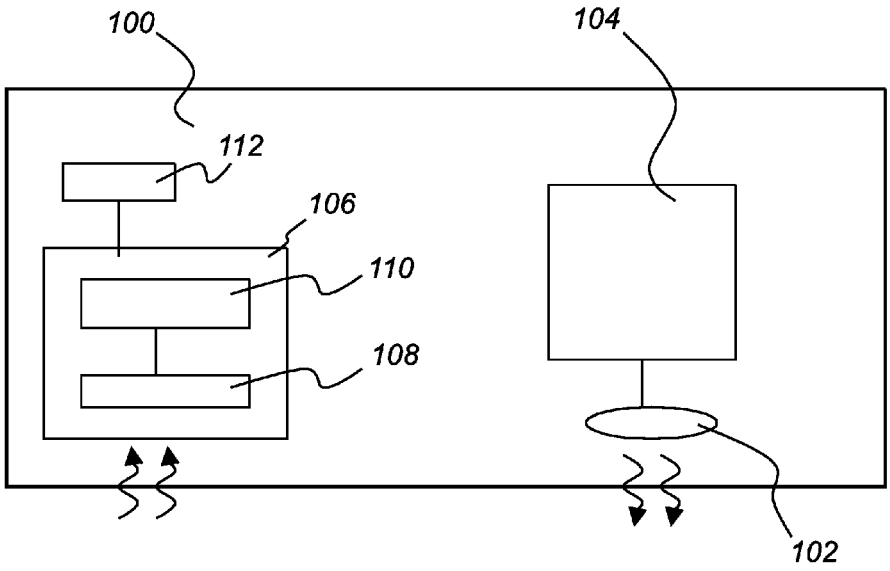
FIGS. 1 and 2 are schematic block diagrams of embodiments of a luminaire according to the present invention.
Figure 2:
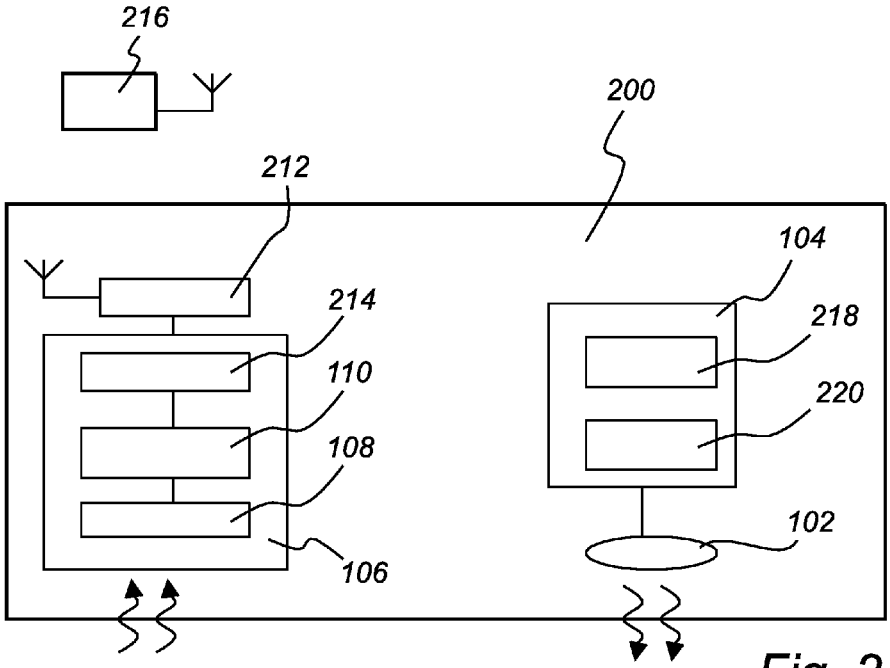
Figure 3:
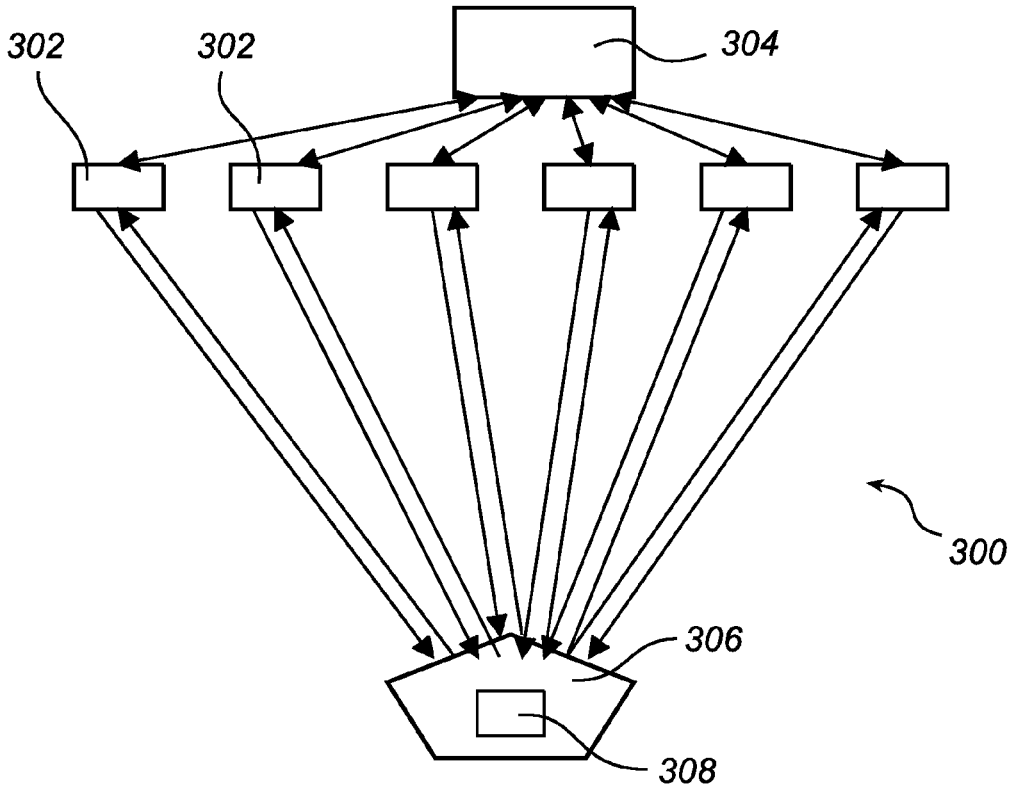
FIG. 3 is a schematic block diagram of an embodiment of a lighting system according to this invention.

Referring to FIG. 1, a luminaire 100 comprises a light source 102, a light coder 104, and a detector unit 106. The detector unit 106 comprises a first identifier 108, and a second identifier 110. The light coder 104 is arranged to code the output light of the luminaire, i.e. the light generated by the light source 102, by means of an individual coding, as will be further explained below. The output light may be white or colored, for instance generated by primary color (red, green, blue, amber, etc) light emitting components comprised in the light source. The light emitting components may be implemented as (gas discharge) bulbs and/or LEDs. Furthermore, the individual coding may be done on the light source 102 level or alternatively on the constituting component level, enabling the primary colors to be identifiable. The detector 106 is arranged to detect received light emanating from a remote reflection of said output light. As will be further explained below, the remote reflection is typically obtained by means of a retro-reflector. More particularly, the first identifier 108 of the detector 106 is arranged to identify a remotely introduced reflector identifying light coding of the received light. By "reflector identifying" is meant a coding that makes it possible to recognize that the reflection has been made at a reflector and not at, for example, a floor or wall or any other object. The second identifier 110 is arranged to identify the individual coding, that is the coding that identifies the luminaire itself and distinguishes it from other individual codings of other luminaires. It should be noted that in a basic embodiment of the luminaire, the individual coding is not employed, i.e. the light coder 104 and the second light identifier 110 are omitted. The identification of light then relies on the light modulation introduced by a remote retro-reflector as will be further described below.

Figure 4:
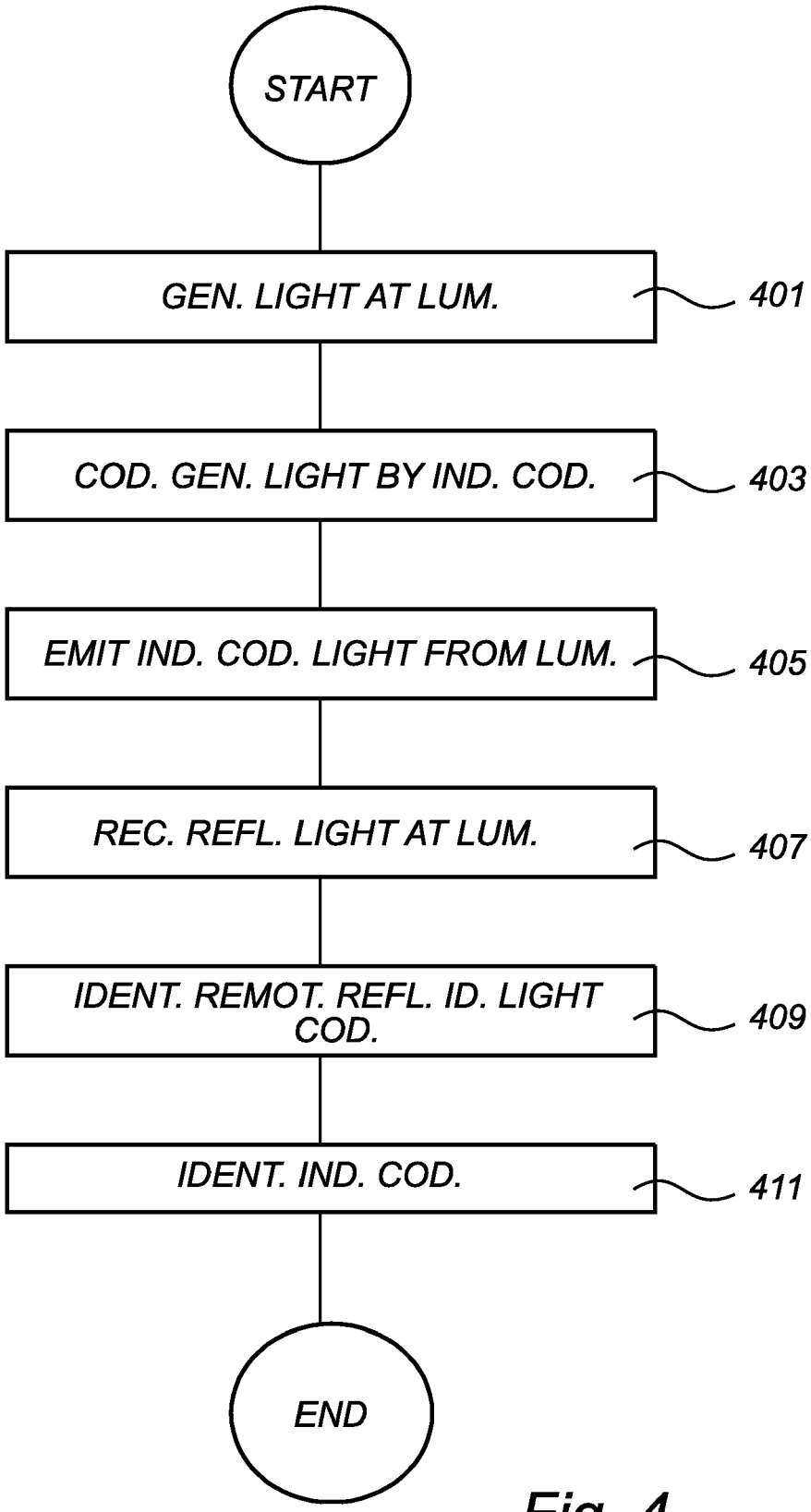
FIG. 4 is a flow chart of an embodiment of a method according to the present invention.

An embodiment of the method that is performed by means of the luminaire comprises generating light at a luminaire, as illustrated in box 401 in FIG. 4. Further it comprises coding the generated light by means of an individual coding, box 403; emitting the thus individually coded light from the luminaire, box 405; receiving, at the luminaire, light emanating from a remote reflection of said individually coded light, box 407; identifying a remotely introduced reflector identifying light coding of the received light, box 409; and identifying said individual coding, box 411. In correspondence with what has been explained above in conjunction with the luminaire, in a simpler embodiment of the method the individual coding can be omitted.

As an alternative, the luminaire 100 further comprises a transmitter 112, which is connected with the detector 106, and which is arranged to transmit light data to an external device. In the embodiment as illustrated the light data consists of, or at least includes, data representing the identified received light (such as the amount of light, the color point of the light, its spectral contents, etc), which may thus be further processed externally of the luminaire.

In another embodiment of the luminaire 200, it comprises the similar units as described in conjunction with the first embodiment above, and additionally, the detector 106 comprises computational capacity provided by a determining means 214, here a microcontroller. The microcontroller 214 is able to determine at least one light property of the received and identified light. For example the light property can be an amplitude or a light power. The microcontroller is arranged to control the output of the luminaire, thereby to obtain a desired level of the light property. The desired level is predetermined. Alternatively, the luminaire 200 additionally comprises a transmitter 212 for transmitting information about said light property to an external device 216. Alternatively, the transmitter 216 is a transceiver. Then it is able to receive control data, which has been set at the external device. The connection is either wireless, as illustrated, or wired.

The light coder 104 typically comprises a pulse width modulator (PWM) 218, and a CDMA (Code Division Multiple Access) modulator 220. That is, the light source 102 is fed with a CDMA modulated voltage, where the CDMA modulation is chosen to be individual, i.e. unique, for the luminaire 200, and consequently adds the individual coding. The PWM determines the intensity of the emitted light. There are other alternative coding techniques as already exemplified above in the summary of the invention. For the illustrated coding the second identifier 110 is a CDMA demodulator.

An embodiment of a lighting system 300 comprises several luminaires 302. Each luminaire 302 emits individually coded, and thus exclusively identifiable, light. A central controller 304 is connected with the luminaires 302. In this embodiment the connection is illustrated as a wire connection, but it can be a wireless connection as well. A retro-reflector 306 is placed at a position where it is desirable to find out the light conditions. A portion of the output light of each luminaire 302 is reflected at the retro-reflector 306 straight back to the source where it came from. Each luminaire 302 delivers data about the received light to the central controller 304, which, in turn, determines some light property of interest, such as amplitude, of the light received at the luminaire 302. In other words, the computational capacity, employed for determining the contribution of each luminaire at the position, is centralized to the central controller. The retro-reflector 306 has a light modulator 308, which in this embodiment is a high frequency modulator such as a piezoelectric transducer. Alternative embodiments have already been indirectly exemplified above as properties of the first identifier of the luminaire, and includes a low frequency modulator, a CDMA modulator and an on/off keying modulator. The choice of the type of coder at the retro-reflector partly is dependent on the type of coder used in the luminaires 302.

Above, embodiments of the luminaire, lighting system and method according to the present invention as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A luminaire comprising a light source emitting output light, and a detector unit arranged to detect received light emanating from a remote reflection of said output light, wherein the detector unit comprises a first identifier, which is arranged to identify a remotely introduced reflector identifying light coding of the received light; and a retro-reflector arranged to provide said remote reflection and including a retro-reflector light coder arranged to code said reflected light by means of said reflector identifying light coding, and a central control unit connected with said luminaire and arranged to process an output signal of said detector unit of said luminaire to determine at least one light property of said output light.

2. A luminaire according to claim 1, further comprising a light coder arranged to code the output light of the luminaire by means of an individual coding, wherein the detector unit further comprises a second identifier arranged to identify said individual coding.

3. A luminaire according to claim 2, wherein said light coder comprises an amplitude modulator, and wherein said first identifier comprises one of a frequency demodulator, a CDMA demodulator, and an on/off keying demodulator.

4. A luminaire according to claim 2, wherein said light coder comprises one of a pulse width modulator, and a combination of a pulse width modulator and a CDMA-modulator, and wherein said first identifier comprises a high frequency demodulator.

5. A luminaire according to claim 2, wherein said light coder comprises a pulse width modulator and a CDMA-modulator, and wherein said first identifier comprises a low frequency demodulator.

6. A luminaire according to claim 1, wherein said detector unit further comprises a light property determining means, arranged to determine at least one light property of the received light.

7. A luminaire according to claim 1, further comprising a transmitter connected with said detector unit for transmitting an output signal thereof.

8. A lighting system according to claim 1, wherein said central control unit is further arranged to determine, on the basis of said at least one light property, a current light effect at a position of the retro-reflector and to control the luminaire in order to obtain a desired light effect at said position.

9. A method for determining a property of light at a remote position comprising:

generating light at a luminaire;

emitting the generated light from the luminaire as output light;

receiving at a retro-reflector said output light;

providing remote reflection of said output light including a reflector identifying light coding inserted into said remote reflection;

receiving, at the luminaire, light emanating from said remote retro-reflection of said output light;

identifying said remotely introduced reflector identifying light coding of the received light by a central control unit connected to said luminaire and arranged to process an output signal of a luminaire detector; and determining a light property of said received light.

10. A method according to claim 9, further comprising:

coding the generated light by means of an individual coding before said emitting the generated light; and identifying said individual coding of the received light.

* * * * *